US010751574B2

(12) United States Patent
Metcalfe et al.

(10) Patent No.: US 10,751,574 B2
(45) Date of Patent: Aug. 25, 2020

(54) BALANCE BOARD

(71) Applicants: Daniel E Metcalfe, Thousand Oaks, CA (US); Robert Eubanks, Thousand Oaks, CA (US)

(72) Inventors: Daniel E Metcalfe, Thousand Oaks, CA (US); Robert Eubanks, Thousand Oaks, CA (US)

( * ) Notice: Subject to any disclaimer, the term of this patent is extended or adjusted under 35 U.S.C. 154(b) by 47 days.

(21) Appl. No.: 15/950,069

(22) Filed: Apr. 10, 2018

(65) Prior Publication Data

US 2019/0308072 A1 Oct. 10, 2019

(51) Int. Cl.
*A63B 26/00* (2006.01)

(52) U.S. Cl.
CPC ..... *A63B 26/003* (2013.01)

(58) Field of Classification Search
CPC ..... A63B 21/0004; A63B 21/00058; A63B 21/00069; A63B 21/00072; A63B 21/00076; A63B 21/00178; A63B 21/00181; A63B 21/00185; A63B 21/00189; A63B 21/002; A63B 21/0023; A63B 21/02; A63B 21/028; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/055; A63B 21/0552; A63B 21/0555; A63B 21/0557; A63B 21/0607; A63B 21/0608; A63B 21/06015; A63B 21/0616; A63B 21/0617; A63B 21/065; A63B 21/068; A63B 21/15; A63B 21/159; A63B 21/4023; A63B 21/4027; A63B 21/4029; A63B 21/4031; A63B 21/4033; A63B 21/4034; A63B 21/4035; A63B 21/4041; A63B 21/4043; A63B 21/4045; A63B 21/4047; A63B 21/4049; A63B 22/0046; A63B 22/14; A63B 22/16; A63B 22/18; A63B 2022/185; A63B 23/02; A63B 23/0205; A63B 23/0211; A63B 23/0216; A63B 23/0222;

(Continued)

(56) References Cited

U.S. PATENT DOCUMENTS 3,862,768 A * 1/1975 England ..... A63B 21/0004 280/205
3,961,787 A * 6/1976 Studebaker ..... A63B 21/0004 273/114

(Continued)

FOREIGN PATENT DOCUMENTS

EP 2583724 4/2013

*Primary Examiner* — Gary D Urbiel Goldner
(74) *Attorney, Agent, or Firm* — Law Office of Scott C Harris, Inc

(57) ABSTRACT

An exercise device having a top surface, the top surface having a left side and a right side, and front and back sides, where the front side includes a location for a user to rest their foot on the top surface in a central part of the top surface, and includes at least one handle location allowing the user to hold on relative to the top surface, where the at least one handle location is attached to the top surface, and also having a bottom surface, and where the bottom surface includes a central pivot point at the central part of the top surface. The central pivot point being between first and second stability points and between left, right, rear, and front stability points.

12 Claims, 4 Drawing Sheets

(58) Field of Classification Search
CPC ..... A63B 23/035; A63B 23/03508; A63B 23/03516; A63B 23/03525; A63B 23/0355; A63B 23/03575; A63B 23/04; A63B 23/0405; A63B 23/0458; A63B 23/0482; A63B 23/0494; A63B 23/08; A63B 23/085; A63B 23/10; A63B 2023/0411; A63B 26/00; A63B 26/003; A63B 2026/006; A63B 71/0054; A63B 71/0009; A63B 2071/0072; A63B 2071/0081; A63B 2208/02; A63B 2208/0204; A63B 2208/0209; A63B 2210/00; A63B 2210/50; A63B 2225/09; A63B 2225/093
See application file for complete search history.

(56) References Cited

U.S. PATENT DOCUMENTS 4,787,630 A * 11/1988 Watson ..... A63B 22/14 482/146
5,643,164 A * 7/1997 Teff ..... A63B 22/16 482/146
5,897,474 A * 4/1999 Romero ..... A63B 22/14 446/396
6,872,175 B2 3/2005 Lin
8,678,985 B2 3/2014 Mattox
8,734,308 B1 * 5/2014 Joslin ..... A63B 22/16 482/142
2010/0087301 A1 * 4/2010 Juncker ..... A63B 21/0004 482/146
2010/0167887 A1 * 7/2010 Berry ..... A63B 22/18 482/147
2013/0053228 A1 * 2/2013 Winegar ..... A63B 22/16 482/146
2013/0324382 A1 12/2013 Wilson
2014/0087927 A1 * 3/2014 Richard ..... A63B 71/0036 482/123
2015/0297946 A1 * 10/2015 Kelley ..... A63B 69/0093 482/129
2017/0043219 A1 * 2/2017 Polinsky ..... A63B 26/003
2017/0095694 A1 * 4/2017 Polinsky ..... A63F 13/211
2017/0232302 A1 * 8/2017 Dedvukaj ..... A63B 26/003 482/123

* cited by examiner

BALANCE BOARD

BACKGROUND

Balance of the human body is a state of function that declines with age. As a body ages, core muscles can weaken and become less toned, leading to less balance.

Exercise of the muscles needed for balance has not been adequately addressed by any known system.

The problem of activities for the older generation have been ignored for the mass population for fear and lack of programs to aid this ignored generation. Most gym equipment and activities, including home equipment, attempts to build strength. However, this equipment does not cover what the inventors believe to be the most important decline in the body—balance.

The inventors believe that balance is the core action while supplementing strength training into the physical action builds functionality for everyday life.

SUMMARY

The invention is created to help re-train the body to find its functionality with balance, lower and upper body strength, agility, mobility and increasing the quality of life in movement and ability to partake in everyday activities.

Embodiments describe a special balance board that enables exercise of the body core. The solution of the embodiments solves the problem of giving back health and movement for physical activity by addressing the body loss of balance and confidence to maintain an active, healthy lifestyle.

BRIEF DESCRIPTION OF THE DRAWINGS

The different figures show different embodiments.

DETAILED DESCRIPTION

The balance board is designed as a platform that has a center flat pivot point that, when stepped on, rocks side to side to a minimum degree. The platform has inclusive holes to attach resistance bands. The front of the platform has a half balance ball for specific balance training and strength for the lower body. The platform has two removable handles for safety and balance assist purposes. The step can also be stabilized with leg attachments. The design covers safety, balance, strength, co-ordination, lower and upper body work, all in one small self contained device.

An advantage of the balance board is its ability to change lives from decline toward improvement. This training will help train to prevent and minimize the falls that many people suffer as they age. By training on a board that supports all aspects of physical needs, everyday life becomes more comfortable. The platform will help with walking, turning, use of stairs, carrying everyday items, and movement for great life function. It will also build confidence to be more active outdoors, helping to lessen obesity gains through inactivity. The overall health of the user will improve and turn back the age clock of physical decline.

Figure 1:
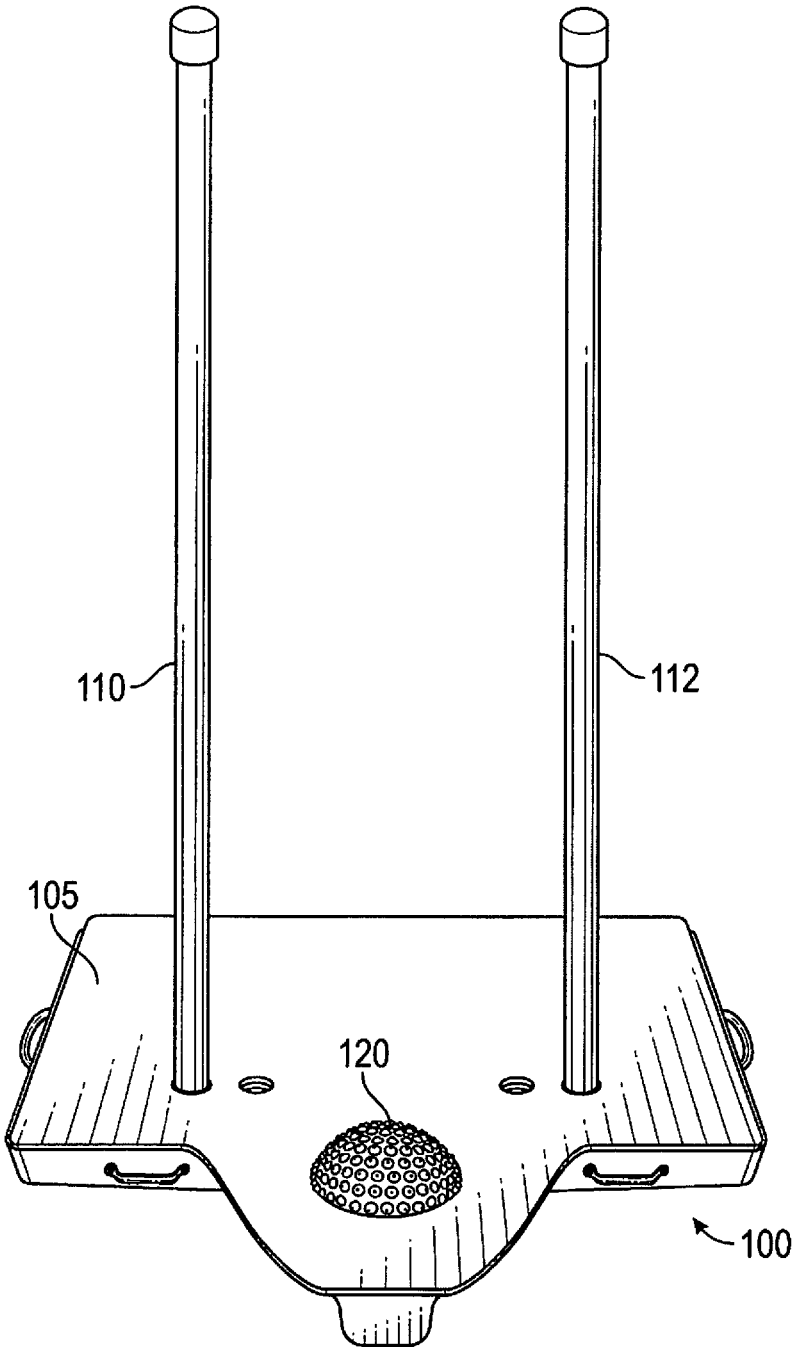
FIG. 1 shows a top perspective view of the balance board.
Figure 2:
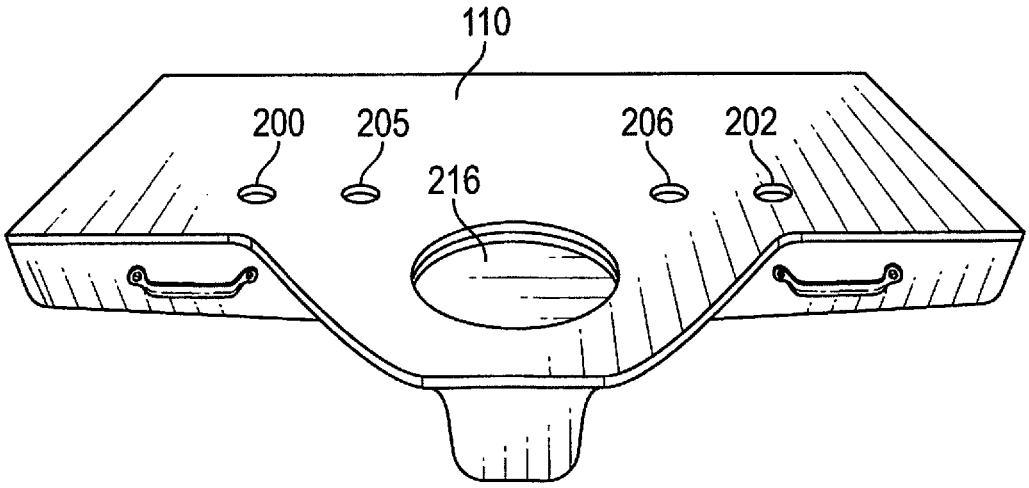
FIG. 2 illustrates the top surface of the balance board and the holes therein.

An embodiment is shown in FIG. 1. FIG. 1 shows a front on perspective view of the balance board assembly 100. The balance board assembly includes a top surface 105 which includes first and second poles 110 and 112 located into holes that are in the top surface. FIG. 2 illustrates how the top surface 105 of the balance board is formed with a number of different holes including outer holes 200, 202 and inner holes 205, 206. In between the inner holes 205, 206 is located an indentation 210 that is substantially circular, and is intended to hold an elastomeric ball device 120, which the user's steps on in order to carry out at least one of the balancing exercises.

FIG. 1 also shows the poles 110, 112 respectively located in the outer holes 200, 202. The poles can be moved into the inner holes 205, 206 for different exercises.

Figure 3:
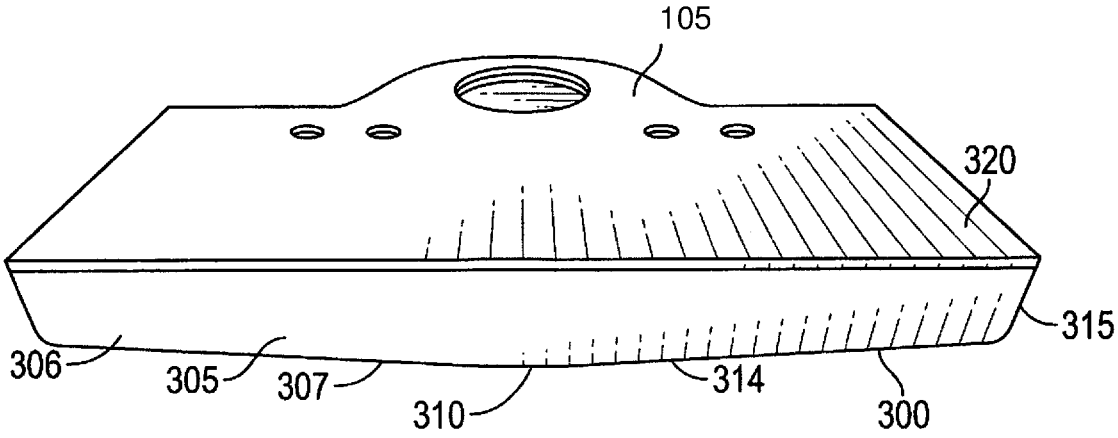
FIG. 3 shows a rear view of the board showing an uneven surface of the balance board.

The base has a number of bottom curvature points explained herein and shown throughout the drawings, which enable the base to be rocked from side to side and front to back while maintaining over all stability and without being tipped over. FIG. 3 illustrates the balance board 100, and illustrates how the bottom surface of the base 300 is uneven, having a substantially seesaw shape, with the first side 305 thinner at its first end 306 and linearly increasing in thickness from the first end 306 to the center portion 310, which is the portion where there is the thickest distance between the top surface 105 of the base 300, and the bottom surface of the base 300. At this thickest portion 310, the base begins again linearly thinning until reaching the second end 315 which is a second end of minimum thickness opposite to the first end. In this way, the bottom of the base is not stable and flat on the floor, but rather is only stable in its two side to side positions including resting on the first end, where the base is resting on a flat surface 307 formed between the first end 306 and the center portion 310, or when it is resting on the second flat surface 314 formed between the center portion 310 and the second end 315. The center portion 310 forms a central pivot point. FIG. 3 also shows the left side 320 of the top surface which forms a first stability point on the left side of the top surface, and the right side 321 of the top surface which forms a second stability point on the right side of the top surface, and the front side 322 of the top surface which forms a third stability point on the front side of the top surface, and the rear side 323 of the top surface which forms a fourth stability point on the rear side of the top surface.

In an alternative embodiment, the surface 307 is not actually flat, but is somewhat curved.

Figure 4:
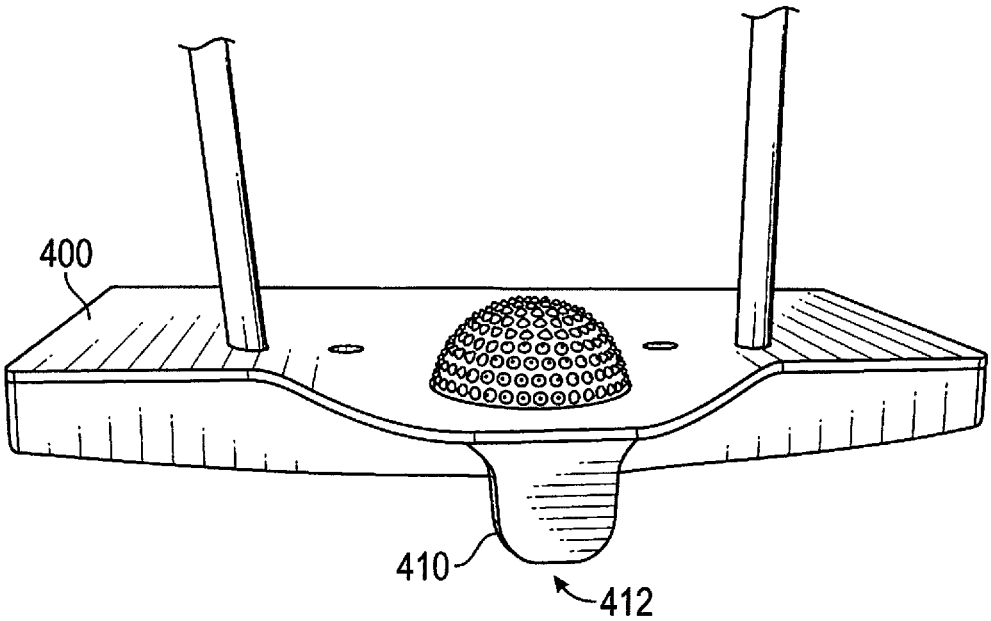
FIG. 4 shows a front perspective view of the balance board, showing two different sections of the bottom surface of the balance board.

FIG. 4 illustrates a face on view of the base, showing how the bottom surface of the base has two different sections. The rear section 400 includes the sizing parameters shown in FIG. 3, where the rear section 400 has a thickness that linearly gets thicker towards the center portion, and linearly gets thinner towards the edge portions, forming an unstable base. The front portion 410, however, extends from the rear portion 400, and includes a rounded bottom portion 412 directly under the location of the elastomeric ball on which the user steps to carry out the exercises.

Figure 5:
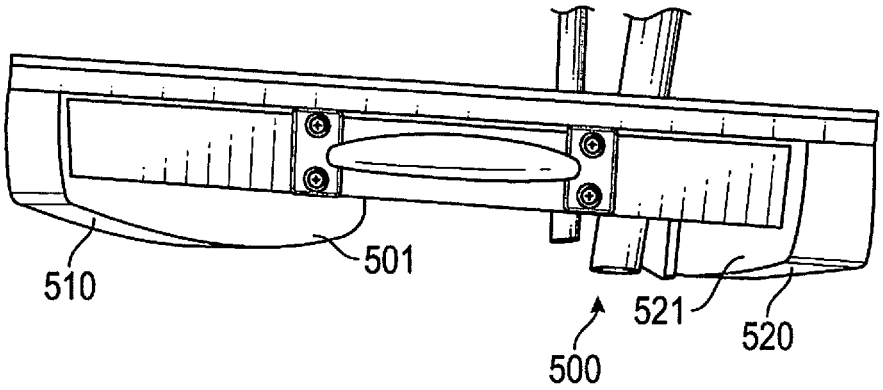
FIG. 5 illustrates a side view of the balance board, showing unstable portions of the balance board from front to back.

FIG. 5 illustrates a side view of the base showing the unstable portions from front to back. The base is thinnest at its central portions 500 and 501. From portion 500 to the first end 520, the base gradually reduces in thickness. Section 500 is actually the bottom portion of the front portion 410. FIG. 5 illustrates an embodiment where there is only structure at certain points such as 510, and other section such as 520 are hollow. Similarly, the center portion 500, 501 includes two structural points, and a hollow section in between them. The section from 501 to the low point at the other end at 510 is similarly a curved section allowing for teetering back and forth, but maintaining stability at either alternate end.

Figure 6:
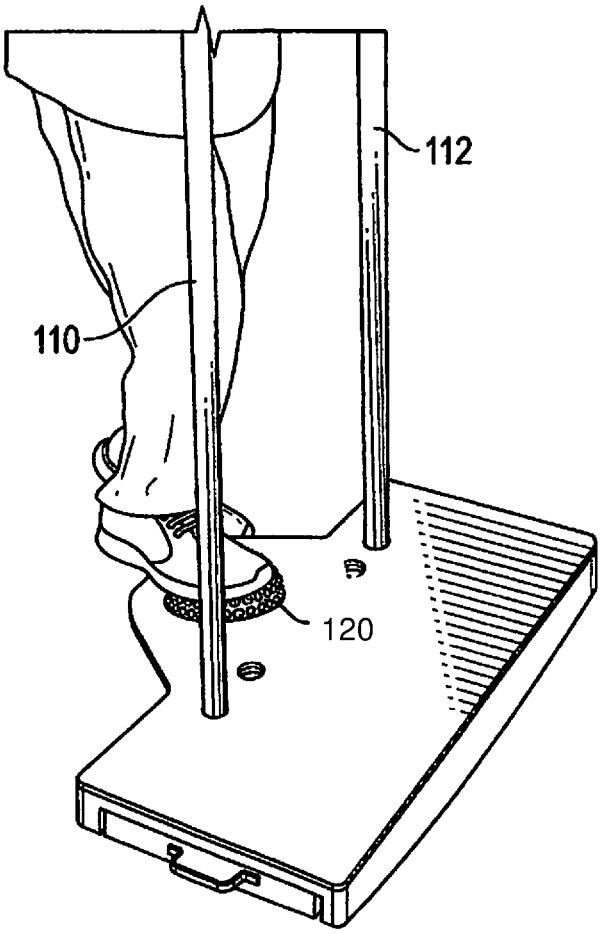
FIG. 6 shows a person stepping on to the balance board.

FIG. 6 illustrates the operation, where the user stands at the ball and of the device, holds onto the handles 110, 112, and stands on the ball 120. While stepping on the elastomeric ball, the user forces the exercise board from one side to the other, thus exercising their core muscles.

The structure of the invention is based off the center flat stability point of the base 300. The curvature off of the base that allows for the platform to be rocked from side to side without danger of tipping over. The front of the design creates a stability ball insert all in one setup. The poles inserted into the platform as unique as a removable stability assist. These can also be used for the physical training segment of the program.

The platform, as a rocker, can be used for upper body strength training due to the need of dynamic muscle contraction to prevent the rocking. The platform is also perfect for abdominal work as shifting of the body weight can change the intensity of the core work from decline to incline training. The built in holes allow for added resistance training with multiple attachments. Additional legs that insert into the base allow for the rocker to be transformed into a solid non-rocking base for additional training programs.

The balance board addresses all aspects of training through this one single device. The device allow low impact core exercises by rocking, solid, height adjustment and multi-entry points of use for the user while providing stability poles to help the user. Removing the poles also creates a larger base platform for additional activities and body function exercises, and makes it easy to store.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An exercise device, comprising:

a base platform comprising:

a top surface having a left region, a right region, a front region, and a back region, wherein the from region includes a central part of the top surface, the central part of the top surface having a location configured for a foot of a user to rest on, the location configured for the foot of the user to rest on having an elastomeric ball, partly recessed into the top surface; and a bottom surface having a central pivot point between a first stability point at a first end of the base platform and a second stability point at a second end of the base platform; and at least one handle attached to the top surface of the base platform.

2. The exercise device as in claim 1, wherein the bottom surface further comprises a third stability point directly under the central part of she front region of the top surface, and a fourth stability point under the hack region of the top surface, the hack region of the top surface opposite to the front region of the top surface, and wherein the central pivot point is between the third stability point and the fourth stability point.

3. The exercise device as in claim 2, wherein the at least one handle includes first and second handles.

4. The exercise device as in claim 3, wherein the first and second handles extend from the top surface, to a point above the top surface, the first and second handles configured to extend such that the user can grasp both the first and second handle while standing with the foot of the user on the central part of the top surface.

5. The exercise device as in claim 4, wherein the first and second handles are- removable from the top surface.

6. The exercise device as in claim 4, wherein the top surface includes a plurality of different holes thereon, the plurality of different holes defining different locations into which the first and second handles can be respectively located.

7. An exercise device, comprising:

a base platform comprising:

a top surface having a left region, a right region, a front region, and a back region, wherein the front region includes a central part of the top surface, the central part of the top surface having a location configured for a foot of a user of rest on;

a bottom surface having a central pivot point between a first stability point at a first end of the base platform and a second stability point at a second end of the base platform; and at least one handle attached to she top surface of the base platform, wherein the bottom surface further comprises a third stability point directly under the central part of the front region of the top surface, and a fourth stability point under the back region of the top surface, the back region of the top surface opposite to the front region of the top surface, and wherein the central pivot point is between the third stability point and the fourth stability point, wherein the at least one handle includes first and second handles, wherein the first and second handles extend from the top surface, to a point above the top surface, the first and second handles configured to extend such that the user can grasp both the first and second handle while standing with the foot of the user on the central part of the top surface, wherein the first and second handles are cylindrical poles.

8. The exercise device as in claim 7, wherein the location configured for the foot of the user to rest on includes an elastomeric ball, partly recessed into the top surface.

9. An exercise device, comprising:

a base platform comprising:

a top surface having a left region, a right region, a front region, and a hack region, the back region being opposite to the front region, wherein the front region includes a central part of the top surface, the central part of the top surface having a location configured for a foot of a user to rest on; and a bottom surface having a central pivot point, a first stability point, a second stability point, a third stability point, and a fourth stability point, the central pivot point being between the first stability point at a first end of the base platform and the second stability point at a second end of the base platform, the third stability point being directly under the central part of the front region of the top surface, and the fourth stability point being under the back region of the top surface, wherein the central pivot point is between the third stability point and the fourth stability point; and two handles attached to the top surface of the base platform, wherein the two handles are a first handle and a second handle, the first and second handles being cylindrical poles.

10. The exercise device as in claim 9, wherein the location configured for the foot of the user to rest on includes an elastomeric ball, partly recessed into the top surface.

11. A method of exercising, comprising:

providing an exercise device comprising:

a base platform comprising:

a top surface having a left region, a right region, a front region, and a back region, the back region being opposite to the front region, wherein the front region includes a central part of the top surface, the central pan of the top surface having a location configured for a foot of a user to rest on; and a bottom surface having a central pivot point, a first stability point, a second stability point, a third stability point, and a fourth stability point, the central pivot point being between the first stability point at a first end of the base platform and the second stability point at a second end of the base platform, the third stability point being directly under the central part of the front region of the top surface, and the fourth stability point being under the back region of the lop surface, wherein the central pivot point is between the third stability point and the fourth stability point; and two handles attached to the top surface of the base platform;

the user standing on the top surface of the base platform with the foot of the user resting on the location of the central part of the top surface of the base platform;

the user holding the two handiest and the user rocking the exercise device from the first stability point to the second stability point and front the third stability point to the fourth stability point, wherein the two handles are a first handle and a second handle, the first and second handles being cylindrical poles.

12. The method as in claim 11, wherein the location configured for the foot of the user to rest on includes and elastomeric ball, partly recessed into the top surface.

* * * * *